US009007045B2

(12) United States Patent
Terada et al.

(10) Patent No.: US 9,007,045 B2
(45) Date of Patent: Apr. 14, 2015

(54) OUTPUT DEVICE WHICH SUPPLIES A CURRENT WITH IMPROVED TRANSIENT RESPONSE CHARACTERISTIC AND REDUCED CURRENT CONSUMPTION

(75) Inventors: Akihiro Terada, Tama (JP); Yoichi Takano, Tama (JP); Shinichiro Maki, Tama (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 190 days.

(21) Appl. No.: 12/793,828

(22) Filed: Jun. 4, 2010

(65) Prior Publication Data

US 2010/0320980 A1 Dec. 23, 2010

(30) Foreign Application Priority Data

Jun. 19, 2009 (JP) ..... 2009-146207

(51) Int. Cl.
*G05F 1/565* (2006.01)
*G05F 1/575* (2006.01)

(52) U.S. Cl.
CPC ..... *G05F 1/575* (2013.01)

(58) Field of Classification Search
CPC ..... G05F 1/575
USPC ..... 323/273–281
See application file for complete search history.

(56) References Cited

U.S. PATENT DOCUMENTS

| | | | | |
|---|---|---|---|---|
| 6,765,374 | B1 * | 7/2004 | Yang et al. | 323/280 |
| 6,798,179 | B2 * | 9/2004 | Nakajima | 323/275 |
| 7,368,896 | B2 * | 5/2008 | Nagata et al. | 323/280 |
| 7,429,852 | B2 * | 9/2008 | Takagi et al. | 323/280 |
| 2002/0130646 | A1 * | 9/2002 | Zadeh et al. | 323/275 |
| 2008/0088286 | A1 * | 4/2008 | Cho et al. | 323/275 |
| 2008/0174289 | A1 * | 7/2008 | Gurcan et al. | 323/280 |
| 2008/0218139 | A1 * | 9/2008 | Takagi | 323/280 |

FOREIGN PATENT DOCUMENTS

| | | |
|---|---|---|
| JP | 2005-353037 | 12/2005 |
| JP | 2007-310521 | 11/2007 |
| JP | 2008-217677 | 9/2008 |

OTHER PUBLICATIONS

Japanese Office Action mailed Jun. 25, 2013 with English translation.

* cited by examiner

*Primary Examiner* — Jue Zhang
(74) *Attorney, Agent, or Firm* — IPUSA, PLLC

(57) ABSTRACT

An output device includes an output transistor that outputs an output current, a first driver that drives the output transistor so that a feedback voltage of an output voltage of the output transistor is in agreement with a reference voltage, an RC circuit that has a capacitor connected to the ground and a resistor connected in series to the capacitor, and a second driver that drives the output transistor to increase the output current when a potential difference between ends of the resistor, generated by the feedback voltage supplied between ends of the RC circuit, is increased by a decrease of the output voltage.

2 Claims, 5 Drawing Sheets

OUTPUT DEVICE WHICH SUPPLIES A CURRENT WITH IMPROVED TRANSIENT RESPONSE CHARACTERISTIC AND REDUCED CURRENT CONSUMPTION

CROSS-REFERENCE TO RELATED APPLICATION

This application is based upon and claims the benefit of priority of Japanese patent application No. 2009-146207, filed on Jun. 19, 2009, the entire contents of which are incorporated herein by reference in their entirety.

BACKGROUND OF THE INVENTION

1. Field of the Invention

This invention relates to an output device which supplies a current to a load.

2. Description of the Related Art

A regulator IC has a problem in that the response of the output gets worse when the load current is changed abruptly. In this context, the term "worse" means that the response becomes nonlinear. For example, in a case of a low power regulator IC, the gain of the amplifier is low and the response gets worse easily. If the response worsens, there may be a possibility that the actual output voltage of the regulator IC is lower than the required output voltage.

For example, FIG. 1 illustrates the composition of a regulator IC according to the related art. In a case of the regulator IC according to the related art in FIG. 1, if a gain of a voltage amplifier 16 is increased or a drive current of a transistor 21 for driving an output transistor 11 is steadily increased, a transient response characteristic of the output of the regulator IC can be improved. In this context, the term "improves" means that the transient response characteristic becomes more linear.

FIG. 2 illustrates the composition of another regulator IC according to the related art. As illustrated in FIG. 2, a voltage amplifier 22 and a transistor 20 are further arranged in the regulator IC illustrated in FIG. 1. In a case of the regulator IC illustrated in FIG. 2, the transient response characteristic of the output can be improved. Namely, a difference between a reference voltage Vref and a feedback voltage Vfb of an output voltage Vout is monitored by the voltage amplifier 22. Only during a transitional period in which the output voltage Vout is lowered due to an increase in the load current, the transistor 20 is turned on by the voltage amplifier 22, so that the transient response characteristic of the output can be improved.

Besides the circuits illustrated in FIG. 1 and FIG. 2, a constant voltage circuit adapted to realize a high speed response to an abrupt change in the load current is known. For example, refer to Japanese Laid-Open Patent Publication No. 2005-353037.

However, if the gain of the voltage amplifier 16 is increased or the drive current of the transistor 21 is steadily increased, in order to improve the transient response characteristic of the output, the current consumption will also be increased.

In the case of the regulator IC illustrated in FIG. 2, both the voltage amplifier 16 and the voltage amplifier 22 are provided to compare the direct current voltage, they are influenced by the input offset of each of the voltage amplifiers, and the current consumption and the transient response characteristic easily fluctuate.

If it is assumed that $\Delta V1$ denotes a first deviation of the input offset of the voltage amplifier 16 and $\Delta V2$ denotes a second deviation of the input offset of the voltage amplifier 22, the total input offset $\Delta V$ of the voltage amplifiers 16 and 22 in combination is represented by $\sqrt{(\Delta V1^2+\Delta V2^2)}$ (or represented by the square root of the sum of the squared first and second deviations). Therefore, the deviation of the input offset in the case of FIG. 2 is as large as the deviation of the input offset of the case of FIG. 1 multiplied by $\sqrt{(1+\Delta V2^2/\Delta V1^2)}$ (or multiplied by the square root of the sum of one and the squared ratio of the second deviation to the first deviation), and the operating point of the gate of the transistor 20 in the case of FIG. 2 easily fluctuates.

In the case of the constant voltage circuit disclosed in Japanese Laid-Open Patent Publication No. 2005-353037, a capacitor C3 is inserted and connected in series between an output terminal OUT of the constant voltage circuit and an input terminal of a differential amplifier circuit AMP2. Hence, it is necessary for this constant voltage circuit that an additional reference voltage generating circuit for inputting the bias voltage Vb1 to the other input terminal of the differential amplifier circuit AMP2 be connected further. Therefore, the current consumption of the whole constant voltage circuit will be increased due to the current consumption of the additional reference voltage generating circuit.

SUMMARY OF THE INVENTION

In one aspect of the invention, the present disclosure provides an output device which can improve the transient response characteristic of the output and can reduce the current consumption.

In an embodiment of the invention which solves or reduces one or more of the above-mentioned problems, the present disclosure provides an output device including: an output transistor that outputs an output current; a first driver that drives the output transistor so that a feedback voltage of an output voltage of the output transistor is in agreement with a reference voltage; an RC circuit that has a capacitor connected to the ground and a resistor connected in series to the capacitor; and a second driver that drives the output transistor to increase the output current when a potential difference between ends of the resistor, generated by the feedback voltage supplied between ends of the RC circuit, is increased by a decrease of the output voltage.

Other objects, features and advantages of the invention will be apparent from the following detailed description when read in conjunction with the accompanying drawings.

DETAILED DESCRIPTION OF PREFERRED EMBODIMENTS

A description will now be given of embodiments of the invention with reference to the accompanying drawings.

Figure 3:
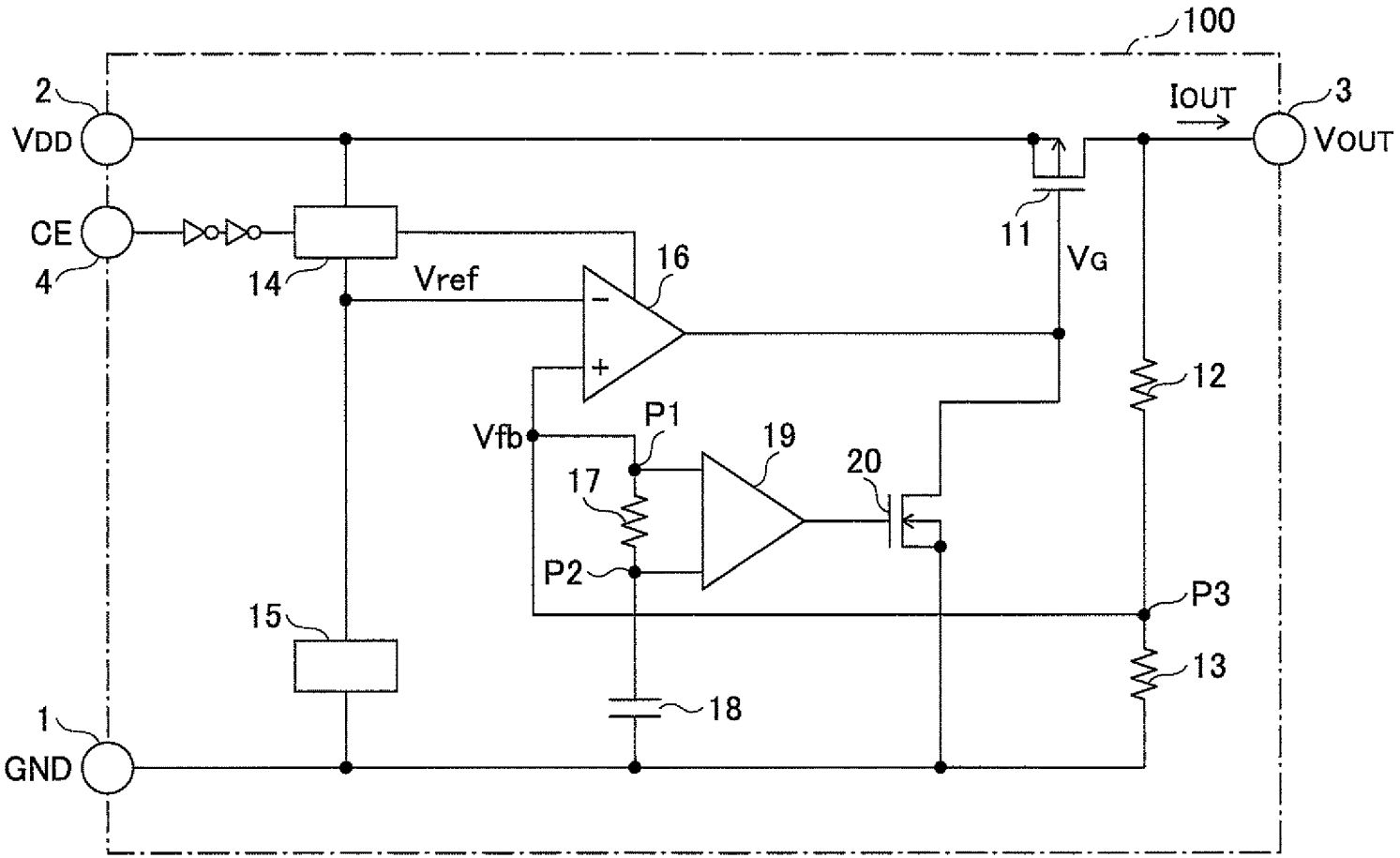
FIG. 3 is a circuit diagram illustrating the composition of a regulator IC which incorporates an output device of a first embodiment of the invention.

FIG. 3 is a circuit diagram illustrating the composition of a regulator IC 100 of a first embodiment of the invention.

As illustrated in FIG. 3, the regulator IC 100 includes a ground terminal 1, a power input terminal 2, an output voltage terminal 3, and a control terminal 4 which are provided as external terminals for connecting the regulator IC 100 to external devices.

The ground terminal 1 is connected to the ground (GND) which is substantially equal to 0 (zero) V. The power input terminal 2 is connected to a power supply line, and an input voltage VDD (for example, 5V) from the power supply line is input to the power input terminal 2. The output voltage terminal 3 is connected to an output line for supplying an output current Iout to a load, and an output voltage Vout from the output voltage terminal 3 is output to the output line. A control signal for switching ON/OFF of the outputting of the output voltage Vout to the output line is input to the control terminal 4.

As illustrated in FIG. 3, the regulator IC 100 is an output device which includes: an output transistor 11 which outputs the output current Iout; a first driver which drives the output transistor 11 so that a feedback voltage Vfb of the output voltage Vout of the output transistor 11 is in agreement with a reference voltage Vref; an RC circuit which has a capacitor 18 connected to the ground and a resistor 17 connected in series to the capacitor 18; and a second driver which has an adjusting part that adjusts the output current Iout by driving the output transistor 11 based on the voltage between the ends of the resistor 17. The expression "in agreement with" means that the feedback voltage Vfb and the reference voltage Vref have the same value. The first driver includes a first voltage amplifier 16. The second driver includes a second voltage amplifier 19 and an adjusting transistor 20.

The output transistor 11 is a PMOS (p-channel metal-oxide semiconductor) transistor inserted between the input terminal 2 and the output terminal 3. A source of the output transistor 11 is connected to the input terminal 2, and a drain of the output transistor 11 is connected to the output terminal 3. A gate of the output transistor 11 is connected to both an output terminal of the voltage amplifier 16 and a drain of the adjusting transistor 20.

The voltage amplifier 16 drives the output transistor 11 by adjusting the gate voltage VG of the output transistor 11 so that the feedback voltage Vfb of the output voltage Vout from the drain of the output transistor 11 is in agreement with the reference voltage Vref. In this case, the voltage amplifier 16 may be arranged so that the current steadily flows into the adjusting transistor 20 in order to supplement the current drainage capability of the output terminal of the voltage amplifier 16.

The feedback voltage Vfb is generated by a feedback circuit which includes two resistors 12 and 13 used to output a divisional voltage of the output voltage Vout. This feedback circuit is a series circuit of the resistors 12 and 13 in which the resistor 12 and the resistor 13 are connected in series. The feedback circuit is inserted between the ground and the intermediate point of the drain of the output transistor 11 and the output terminal 3. The junction point P3 of the resistor 12 and the resistor 13 is connected to one of the differential input terminals of the voltage amplifier 19 and connected to one of the differential input terminals of the voltage amplifier 16.

The voltage amplifier 16 adjusts the amplitude of the gate voltage VG of the output transistor 11 in accordance with the amplitude of the difference between the feedback voltage Vfb and the reference voltage Vref. The larger the difference voltage D1 between the reference voltage Vref and the feedback voltage Vfb is, the smaller the gate voltage VG of the output transistor 11 adjusted by the voltage amplifier 16 is. The gate voltage VG is decreased in inverse proportion to the difference voltage D1, and the output current Iout can be increased smoothly.

The voltage amplifier 16 operates as a constant current generated by the constant current source 14 which operates with the input voltage VDD is supplied to the voltage amplifier 16. The constant current source 14 switches ON/OFF the outputting of the constant current to the voltage amplifier 16 in accordance with the control signal input from the control terminal 4. The constant current generated by the constant current source 14 is supplied to the constant-voltage source 15 as well. The constant-voltage source 15 generates a constant reference voltage Vref as the constant current from the constant current source 14 is supplied to the voltage amplifier 16. The constant-voltage source 15 is, for example, a band gap circuit.

The differential input terminals of the voltage amplifier 19 are connected to the ends of the resistor 17 in the RC circuit to which the feedback voltage Vfb on the basis of the ground is supplied. The RC circuit includes the resistor 17 and the capacitor 18 connected in series to the resistor 17. One end of the capacitor 18 is connected to the ground, and the other end of the capacitor 18 is connected to one end of the resistor 17.

The voltage amplifier 19 drives the output transistor 11 by operating the adjusting transistor 20 so that the output current Iout is increased as the potential difference D2 between the ends of the resistor 17 is increased. The potential difference D2 is generated by supplying the feedback voltage Vref between the ends of the RC circuit. The voltage amplifier 19 operates the adjusting transistor 20 so that the gate voltage VG of the output transistor 11 is decreased as the potential difference D2 is increased in accordance with the decrease of the output voltage Vout due to the increase of the load current. The gate voltage VG is decreased in inverse proportion to the potential difference D2, and the output current Iout can be increased smoothly.

The adjusting transistor 20 adjusts the gate voltage VG so that the adjusted gate voltage VG is decreased in accordance with the amplitude of the output voltage of the voltage amplifier 19. A drain of the adjusting transistor 20 is connected to the gate of the output transistor 11, a source of the adjusting transistor 20 is connected to the ground, and a gate of the adjusting transistor 20 is connected to the output terminal of the voltage amplifier 19. Examples of the adjusting transistor 20 may include an NMOS transistor and an NPN bipolar transistor. If the charging or discharging of the capacitor 18 is stopped, no potential difference D2 between the ends of the resistor 17 is produced, and the operation of the adjusting transistor 20 by the voltage amplifier 19 is stopped. In the state in which no potential difference D2 is produced, the adjusting transistor 20 does not operate based on the output of the voltage amplifier 19. However, it may be arranged so that the drain current flows steadily, in order to supplement the current drainage capability of the output of the voltage amplifier 16 and obtain a desired output voltage Vout and a desired output current Iout.

Alternatively, the voltage amplifier 19 may be arranged as a comparator which is operated to output either a high-level output signal or a low-level output signal depending on a result of comparison between the voltage at the junction point P1 (located at one end of the resistor 17) and the voltage at the junction point P2 (located at the other end of the resistor 17). For example, the voltage of the capacitor 18 is set to a threshold voltage of the comparator 19 having the hysteresis (which is equal to the potential of the junction point P2). In this case, when the difference between the feedback voltage Vfb input to the comparator 19 and the threshold voltage is above a predetermined value, the comparator 19 outputs the high-level output signal to the gate of the adjusting transistor 20. When the difference between the input feedback voltage Vfb and the threshold voltage is below the predetermined value, the comparator 19 outputs the low-level output signal to the gate of the adjusting transistor 20.

That is, if the decrease of the output voltage Vout due to the increase of the load current occurs, the potential difference D2 between the voltage at the junction point P1 and the voltage at the junction point P2 is temporarily above the predetermined value. When the potential difference D2 is temporarily above the predetermined value, the comparator 19 outputs the high-level output signal to the gate of the adjusting transistor 20. Therefore, the adjusting transistor 20 can be operated so that the gate voltage VG of the output transistor 20 is decreased until the temporary decline of the output voltage Vout is recovered to the normal level (or decreased when the potential difference D2 is above the predetermined value).

Figure 4:
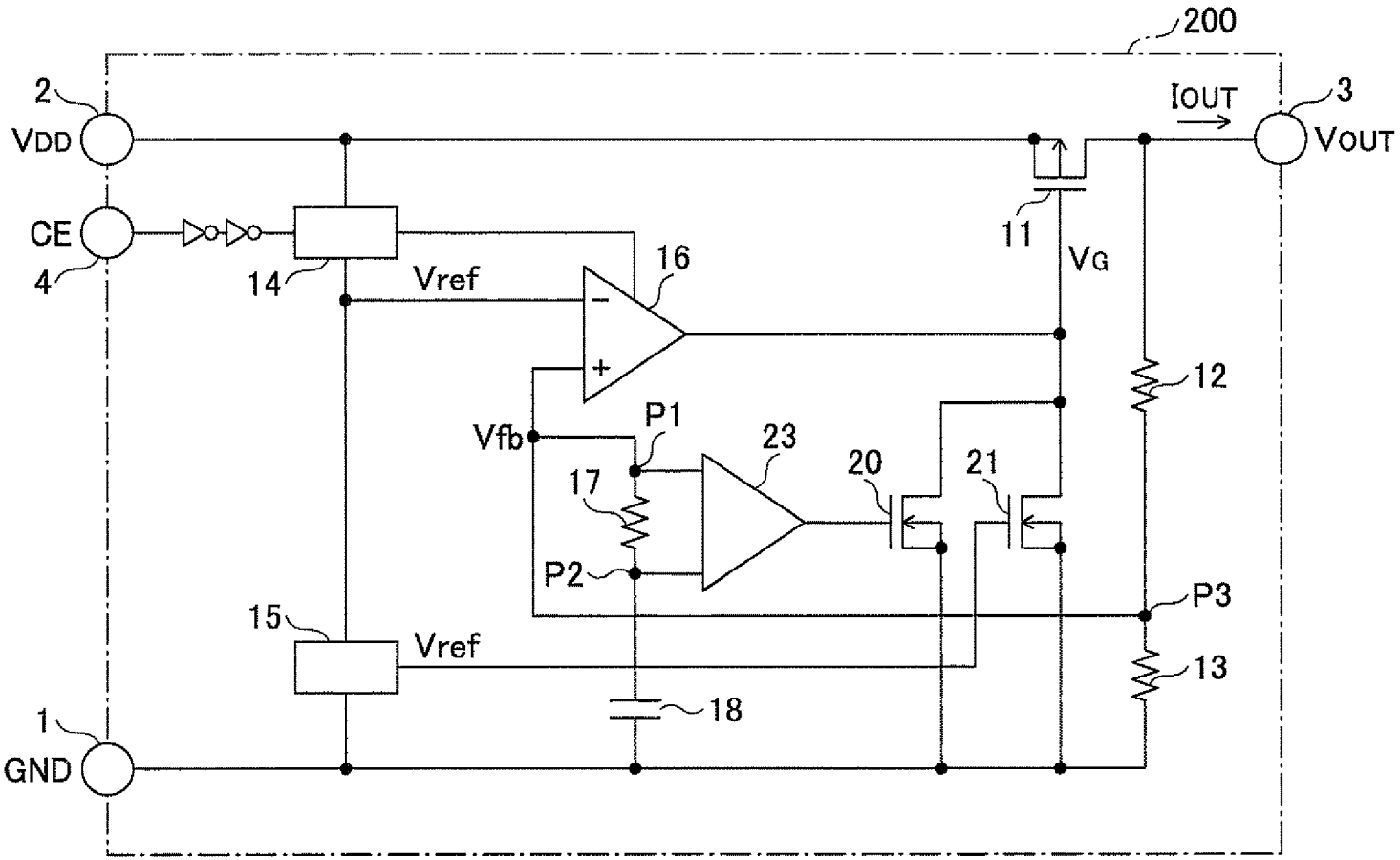
FIG. 4 is a circuit diagram illustrating the composition of a regulator IC which incorporates an output device of a second embodiment of the invention.

Next, FIG. 4 is a circuit diagram illustrating the composition of a regulator IC 200 of a second embodiment of the invention. In FIG. 4, the elements which are the same as corresponding elements in FIG. 3 are designated by the same reference numerals and a description thereof will be omitted.

As illustrated in FIG. 4, the regulator IC 200 is an output device which includes: an output transistor 11 which outputs the output current Iout; a first driver which drives the output transistor 11 so that a feedback voltage Vfb of the output voltage Vout of the output transistor 11 is in agreement with a reference voltage Vref; an RC circuit which has a capacitor 18 connected to the ground and a resistor 17 connected in series to the capacitor 18; and a second driver which has an adjusting part that adjusts the output current Iout by driving the output transistor 11 based on the voltage between the ends of the resistor 17. The first driver includes a first voltage amplifier 16 and a first adjusting transistor 21. The second driver includes a second voltage amplifier 23 and a second adjusting transistor 20.

The output transistor 11 is a PMOS transistor inserted between the input terminal 2 and the output terminal 3. A gate of the output transistor 11 is connected to each of an output terminal of voltage amplifier 16, a drain of the adjusting transistor 20, and a drain of the adjusting transistor 21.

The voltage amplifier 16 drives the output transistor 11 by adjusting the gate voltage VG of the output transistor 11 so that the feedback voltage Vfb of the output voltage Vout from the drain of the output transistor 11 is in agreement with the reference voltage Vref. In this case, the adjusting transistor 21 which operates in accordance with the reference voltage Vref functions as a constant current source for supplying the constant drain current steadily. Examples of the adjusting transistor 21 may include an NMOS transistor and an NPN bipolar transistor. The reference voltage Vref is steadily supplied between the gate and the source of the adjusting transistor 21. The reference voltage Vref which is the same as the reference voltage supplied to the voltage amplifier 16 is supplied to the adjusting transistor 21 and the adjusting transistor 21 functions as a constant current source which drives the gate of the output transistor 11. The junction point P3 of the resistor 12 and the resistor 13 is connected to one of the differential input terminals of the voltage amplifier 23 and connected to one of the differential input terminals of the voltage amplifier 16.

The voltage amplifier 23 drives the output transistor 11 by operating the adjusting transistor 20 so that the output current Iout increases as the potential difference D2 between the ends of the resistor 17 (which are connected to the differential input terminals of the voltage amplifier 23) increases. The potential difference D2 is generated by supplying the feedback voltage Vref between the ends of the RC circuit.

The voltage amplifier 23 operates the adjusting transistor 20 so that the gate voltage VG of the output transistor 11 is decreased as the potential difference D2 is increased in accordance with the decrease of the output voltage Vout due to the increase of the load current. The gate voltage VG is decreased in inverse proportion to the potential difference D2, and the output current Iout can be increased smoothly.

Alternatively, the voltage amplifier 23 may be arranged as a comparator which is operated to output a control signal for selectively switching ON/OFF of the adjusting transistor 20. For example, the voltage of the capacitor 18 is set to a threshold voltage of the comparator 23 having the hysteresis (which is the potential of the junction point P2). In this case, the comparator 23 may be arranged to output a control signal for switching ON the adjusting transistor 20 when the difference between the feedback voltage Vfb and the threshold voltage is above a predetermined value.

Alternatively, similar to the voltage amplifier 19 in the previous embodiment of FIG. 3, the voltage amplifier 23 may be arranged as a comparator which is operated to output either a high-level output signal or a low-level output signal depending on a result of comparison of the voltage at the junction point P1 (which is located at one end of the resistor 17) and the voltage at the junction point P2 (which is located at the other end of the resistor 17).

Figures 5A, 5B, 5C:
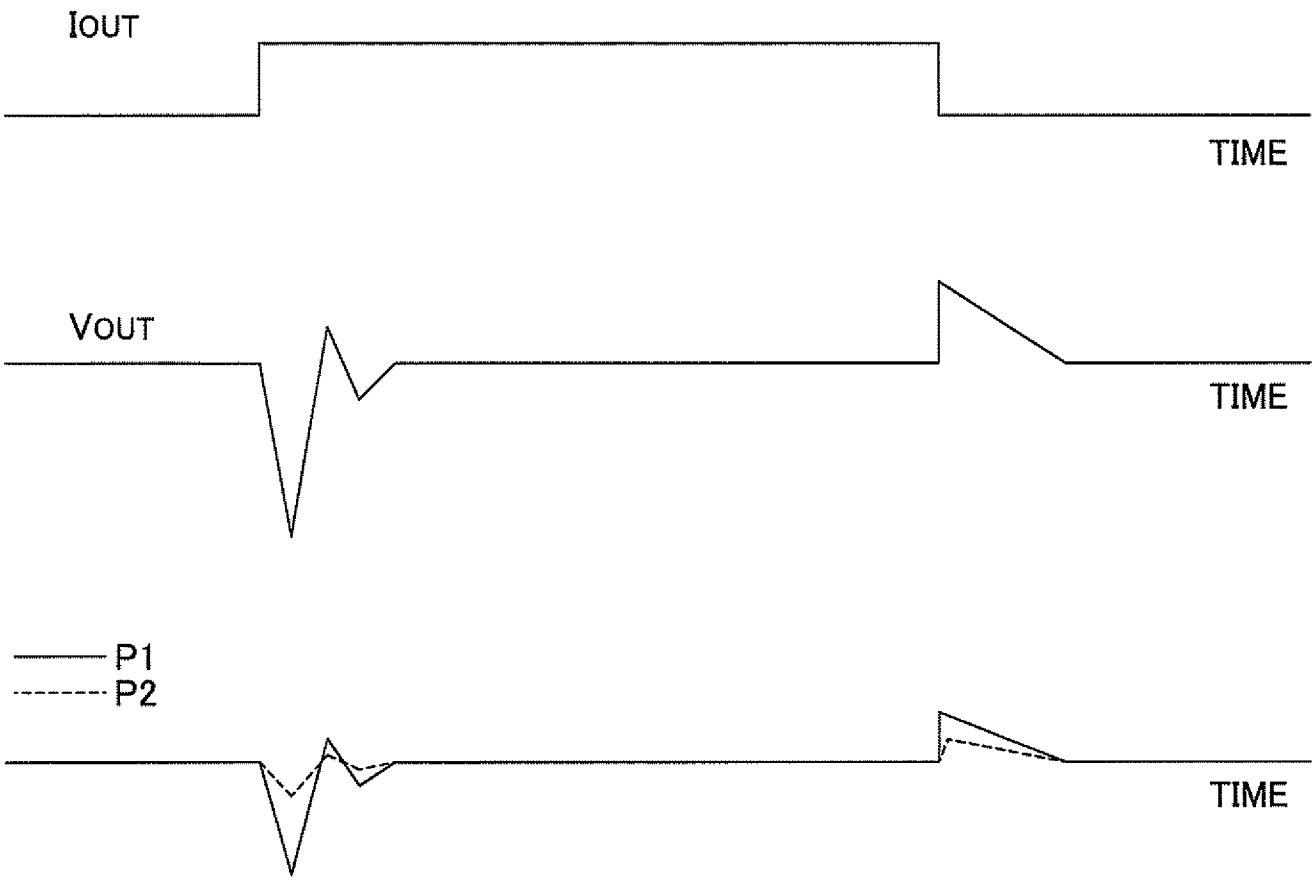
FIG. 5A, FIG. 5B, and FIG. 5C are timing charts for explaining operation of the regulator IC illustrated in FIG. 3 or FIG. 4.

FIG. 5A, FIG. 5B, and FIG. 5C are timing charts for explaining operation of the regulator IC 100 illustrated in FIG. 3 or the regulator IC 200 illustrated in FIG. 4.

When the output current Iout is abruptly increased due to an abrupt increase of the load current (see FIG. 5A), the output voltage Vout is decreased temporarily (see FIG. 5B). FIG. 5C is a timing chart illustrating a change of the voltage at the junction point P1 and a change of the voltage at the junction point P2 which are the ends of the resistor 17 connected to the input terminals of the voltage amplifier 19 (23). When the output voltage Vout is in a steady state and the reference voltage Vref and the feedback voltage Vfb are substantially equal to each other, the charging current does not flow into the capacitor 18 via the junction point P3 and the resistor 17. In this state, the potential difference D2 due to a drop of the voltage of the resistor 17 is not present.

When the output voltage Vout is decreased by an increase of the load current, the drop of the output voltage Vout causes the feedback voltage Vfb to be lowered. If the feedback voltage Vfb at the junction point P1 (P3) is lowered, the discharge current flows from the capacitor 18 having a potential higher than the lowered feedback voltage Vfb, and the potential at the junction point P2 is also lowered. A voltage drop (potential difference) between the ends of the resistor 17 is present by the flow of the discharging current from the capacitor 18. Hence, in the transient state in which the output voltage Vout is temporarily falling by the increase of the load current, the potential at the junction point P2 is higher than the potential at the junction point P1.

Therefore, the voltage amplifier 19 (23) is arranged to operate the adjusting transistor 20 to decrease the gate voltage VG of the output transistor 11 when the potential difference D2 between the voltage at the junction point P1 and the voltage at the junction point P2 is increased. In other words, the voltage amplifier 19 (23) is arranged to operate the adjusting transistor 20 to increase the gate voltage VG of the output transistor 11 when the potential difference D2 between the voltage at the junction point P1 and the voltage at the junction point P2 is decreased.

Alternatively, the comparator 19 (23) may be arranged to operate the adjusting transistor 20 to decrease the gate voltage VG of the output transistor 11 only when the potential difference D2 between the voltage at the junction point P1 and the voltage at the junction point P2 is above the predetermined value.

Figure 1:
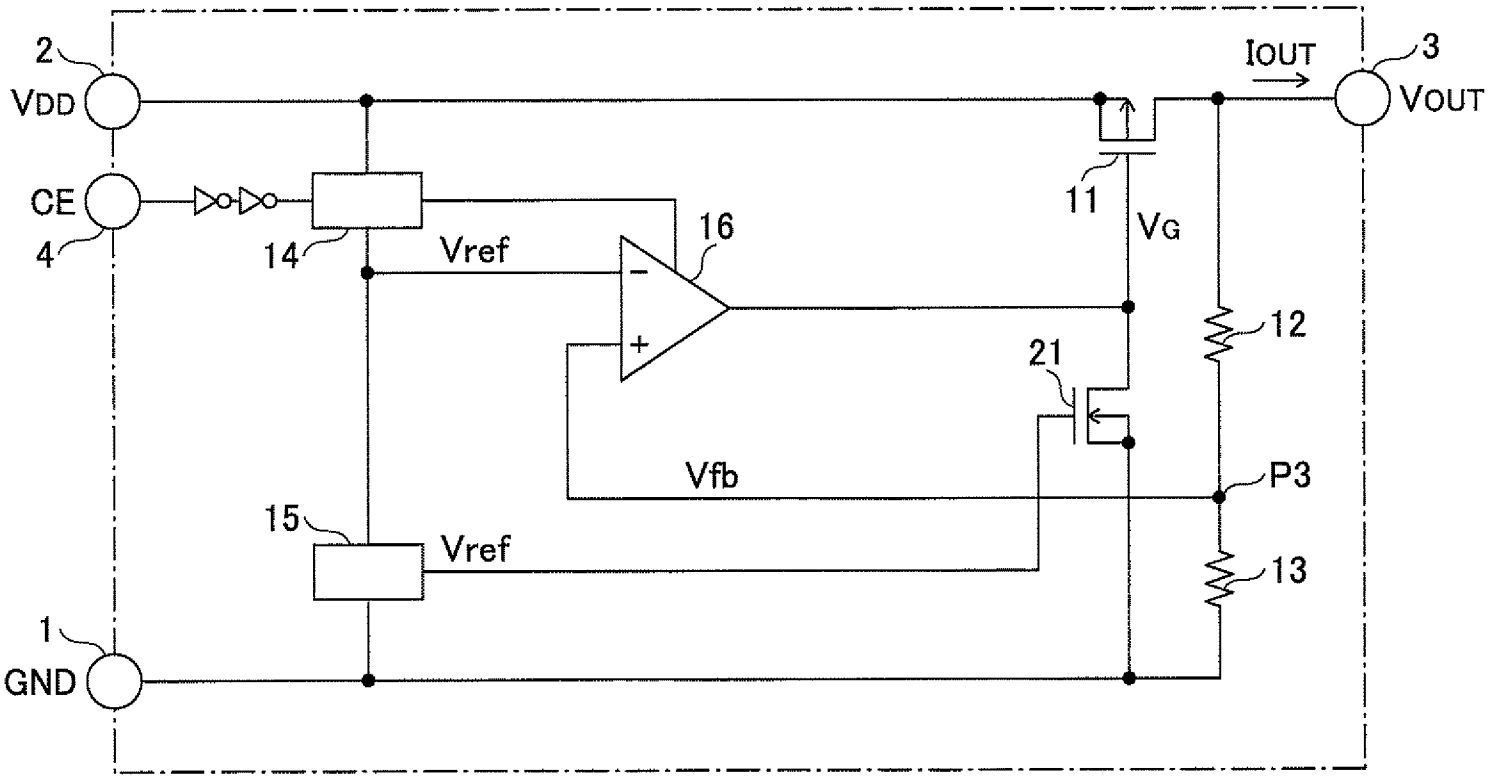
FIG.1 RELATED ART
FIG. 1 is a circuit diagram illustrating the composition of a regulator IC according to the related art.
Figure 2:
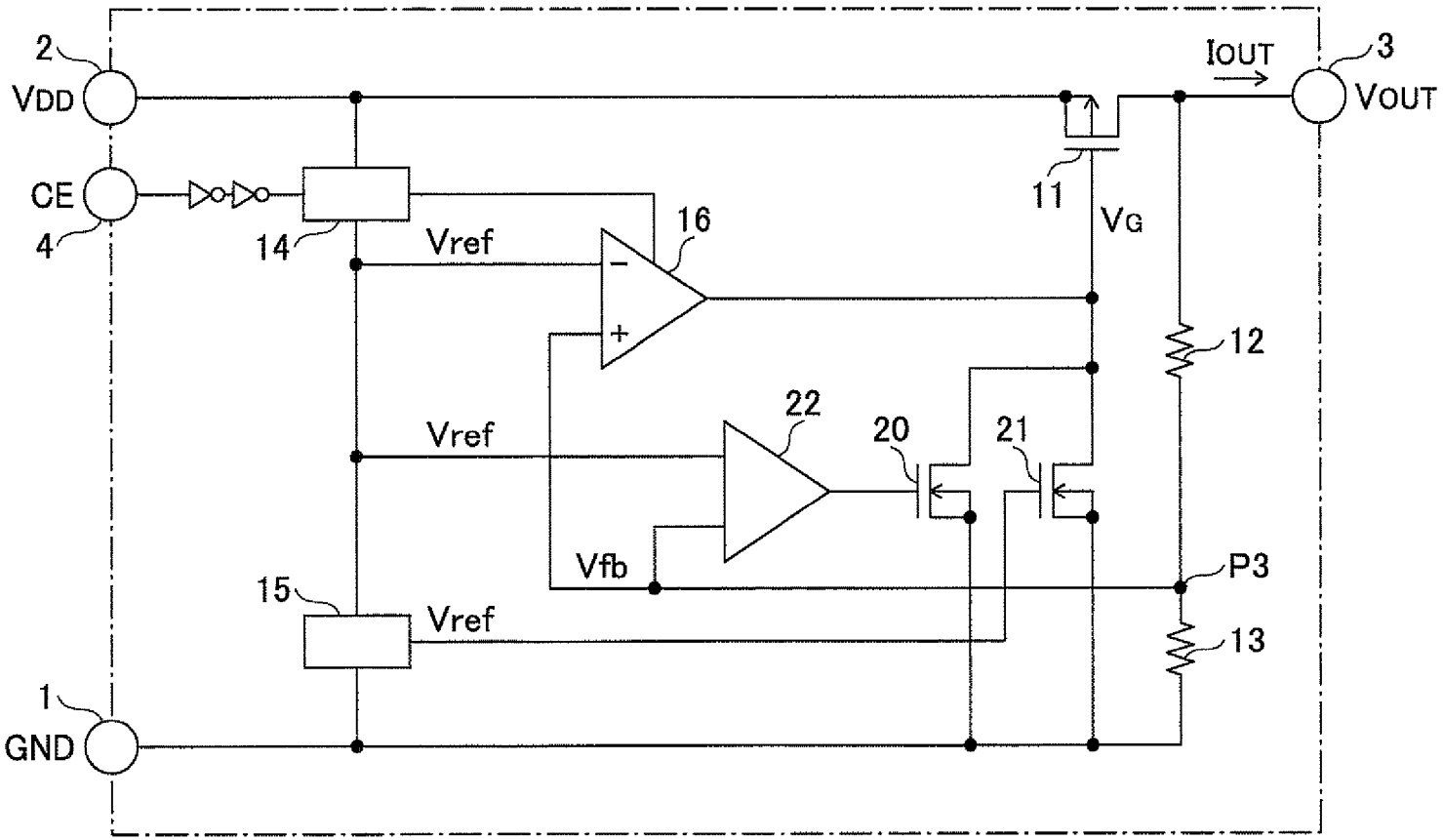
FIG.2 RELATED ART
FIG. 2 is a circuit diagram illustrating the composition of a regulator IC according to the related art.

As described in the foregoing, in the above-described regulator IC 100 or 200, the transient response characteristic when the output voltage Vout temporarily falls from the required voltage can be improved. In the case of the above-described regulator IC 100 or 200, the voltage amplifier 19 (23) operates only when the charging or discharging of the capacitor 18 is performed, otherwise the voltage amplifier 19 (23) stops the operation. In the case of FIG. 1 or FIG. 2, it is required to always compare the two direct-current voltages: the reference voltage Vref and the feedback voltage Vfb. Hence, in the above-described regulator IC 100 or 200, the current consumption can be reduced not only in the steady state where the load current is constant but also in the no-load state.

In order to reduce the current consumption in the steady state, the gain of the voltage amplifier 19 (23) and the gate threshold for switching ON the adjusting transistor 20 may be set up by adjustment so that the OFF state of the adjusting transistor 20 is maintained in the steady state.

In the case of the above-described regulator IC 100 or 200, the reference voltage generating circuits as in the constant voltage circuit disclosed in Japanese Laid-Open Patent Publication No. 2005-353037 are not arranged. It is possible for the present disclosure to eliminate the increase of the current consumption by the reference voltage generating circuits being arranged in the constant voltage circuit.

In the above-described regulator IC 100 or 200, the deviation in the transient response characteristic and the deviation in the current consumption can be reduced. In the case of the above-described regulator IC 100 or 200, the transient response characteristic is improved with the components different from the feedback loop including the voltage amplifier 16. In the case of the circuit according to the related art, the transient response characteristic is improved with the components within the feedback loop including the voltage amplifier 16. Hence, in the above-described regulator IC 100 or 200, the deviation in the transient response characteristic and the deviation in the current consumption can be reduced.

In the case of FIG. 2, the two different voltages, the reference voltage Vref and the feedback voltage Vfb, are input to the differential input terminals of the voltage amplifier 22. On the other hand, in the case of the above-described regulator IC 100 or 200, the two input voltages are generated from one feedback voltage Vfb and input to the differential input terminals of the voltage amplifier 19 (23). Because the two input voltages are generated from one voltage in the case of the above-described regulator IC 100 or 200, the deviation in the current consumption and the deviation in the transient response characteristic can be reduced.

In the case of FIG. 2, the total input offset ΔV which is the sum of the input offsets of the voltage amplifiers 16 and 22 in combination is represented by $\sqrt{(\Delta V1^2+\Delta V2^2)}$. On the other hand, in the case of FIG. 3 or FIG. 4, the total input offset ΔV is equal to the input offset ΔV2 of the voltage amplifier 19 (23). Hence, the deviation in the input offset in the case of FIG. 3 or FIG. 4 can be reduced to $1/\sqrt{(1+\Delta V2^2/\Delta V1^2)}$ of that in the case of FIG. 2.

In a steady state, the feedback voltage Vfb is stably constant and the input terminals of the voltage amplifier 19 (23) are at the same potential. Hence, only the deviation in the input offset ΔV2 of the input terminal of the voltage amplifier 19 (23) is present in the total input offset ΔV.

According to the present disclosure, the transient response characteristic of the output can be improved and the current consumption can be reduced.

The present disclosure is not limited to the above-described embodiments, and variations and modifications may be made without departing from the scope of the invention. Although the exemplary regulator IC has been illustrated in the above-described embodiments, the output device according to the present disclosure may also be applied to a DC-DC converter or a load driving device.

What is claimed is:

1. An output device comprising:

an output transistor that outputs an output current;

an output voltage terminal from which an output voltage of the output transistor is output;

a DC-coupled feedback circuit that includes a first resistor and a second resistor connected in series between a ground and a point between the output transistor and the output voltage terminal, and generates a feedback voltage as a scaled-down output voltage of the output transistor, wherein a first terminal of the first resistor is connected to the point between the output transistor and the output voltage terminal, a second terminal of the first resistor is connected to a first terminal of the second resistor, and a second terminal of the second resistor is connected to the ground;

a first driver that drives the output transistor so that the feedback voltage is in agreement with a reference voltage, wherein the output of the first driver connects directly to the gate of the output transistor;

an RC circuit including a capacitor and a third resistor connected in series to the capacitor, wherein one end of the third resistor is connected to a point between the second terminal of the first resistor and the first terminal of the second resistor, another end of the third resistor is connected to one end of the capacitor, and another end of the capacitor is connected to the ground; and a second driver that drives the output transistor to increase the output current when a potential difference between the ends of the third resistor, generated by the feedback voltage supplied between ends of the RC circuit, is increased by a decrease of the output voltage, wherein the second driver includes a comparator that detects the potential difference, and an adjusting transistor that adjusts the output current by driving the output transistor in accordance with an output signal from the comparator, the adjusting transistor including a gate connected to an output terminal of the comparator, a source connected to the ground, and a drain connected to a gate of the output transistor, and wherein the comparator is arranged to operate the adjusting transistor to decrease a gate voltage of the output transistor when the potential difference is increased, and to operate the adjusting transistor to increase the gate voltage of the output transistor when the potential difference is decreased.

2. The output device according to claim 1, wherein the first driver includes a constant current source which supplies the reference voltage to the first driver, and the constant current source supplies a current for driving the output transistor.

* * * * *